US012678706B2

(12) United States Patent
Parr et al.

(10) Patent No.: US 12,678,706 B2
(45) Date of Patent: Jul. 14, 2026

(54) SYSTEMS AND METHODS FOR CONTROLLING SPECIAL EFFECTS OF REACTIVE SHOW ACTION EQUIPMENT

(71) Applicant: Universal City Studios LLC, Universal City, CA (US)

(72) Inventors: Eric Rae Parr, Orlando, FL (US); Gary Lynn Blumenstein, Jr., Apopka, FL (US); Kimberley Marie Gritzer, Orlando, FL (US); Keith Michael McVeen, Winter Garden, FL (US); Elias Varon, Orlando, FL (US); Sarah Anne Kelley, Orlando, FL (US); Eric Allan Vance, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 522 days.

(21) Appl. No.: 18/165,785

(22) Filed: Feb. 7, 2023

(65) Prior Publication Data

US 2024/0189734 A1 Jun. 13, 2024

Related U.S. Application Data

(60) Provisional application No. 63/387,218, filed on Dec. 13, 2022.

(51) Int. Cl.
*A63J 5/02* (2006.01)
*A63J 5/04* (2006.01)

(52) U.S. Cl.
CPC ..... *A63J 5/023* (2013.01); *A63J 5/025* (2013.01); *A63J 5/04* (2013.01)

(58) Field of Classification Search
CPC ..... A63J 5/00; A63J 5/02; A63J 5/023; A63J 5/025; A63J 5/028; A63J 5/04
See application file for complete search history.

(56) References Cited

U.S. PATENT DOCUMENTS 11,651,501 B2 * 5/2023 Comito ..... G06T 7/292 382/159
2015/0300635 A1 * 10/2015 Blum ..... F23D 17/00 431/12

(Continued)

OTHER PUBLICATIONS

PCT/US2023/083645 International Search Report and Written Opinion mailed May 7, 2024.

*Primary Examiner* — Bao-Luan Q Le
(74) *Attorney, Agent, or Firm* — Fletcher Yoder, P.C.

(57) ABSTRACT

A reactive show action equipment system is disclosed, including show action equipment having one or more actuators and a special effects system coupled to the show action equipment. The special effects system includes an effects source and an effect emitter configured to expel a substance from the effects source to provide a special effect. The reactive show action equipment system also includes a sensor configured to detect a characteristic of the special effect or a characteristic impactful to the special effect and transmit data indicative of the characteristic. A control system is configured to receive the data indicative of the characteristic and instruct the one or more actuators based on the data indicative of the characteristic. In some embodiments, one or more components of the special effects system may be onboard the show action equipment.

20 Claims, 5 Drawing Sheets

(56) References Cited

U.S. PATENT DOCUMENTS

| | | | | |
|---|---|---|---|---|
| 2016/0059145 | A1* | 3/2016 | Cortelyou | A63J 5/04 472/57 |
| 2017/0166221 | A1* | 6/2017 | Osterman | A63G 31/00 |
| 2018/0140957 | A1* | 5/2018 | Woodcock | A63G 1/10 |
| 2018/0329480 | A1* | 11/2018 | Schwartz | A63F 13/00 |
| 2020/0184864 | A1* | 6/2020 | Garnier | G09G 3/001 |
| 2021/0179013 | A1* | 6/2021 | Malatek | B60R 22/48 |
| 2021/0205999 | A1* | 7/2021 | Mecca | G09F 19/18 |
| 2021/0268393 | A1 | 9/2021 | Smith | |
| 2021/0291071 | A1* | 9/2021 | Brister | A63J 21/00 |
| 2022/0096951 | A1 | 3/2022 | Duffy et al. | |
| 2022/0214742 | A1 | 7/2022 | Yeh et al. | |
| 2022/0258044 | A1* | 8/2022 | Magpuri | A63J 5/00 |

* cited by examiner

SYSTEMS AND METHODS FOR CONTROLLING SPECIAL EFFECTS OF REACTIVE SHOW ACTION EQUIPMENT

CROSS-REFERENCE TO RELATED APPLICATION

This application claims priority to and the benefit of U.S. Provisional Application No. 63/387,218 filed Dec. 13, 2022, entitled "REACTIVE SHOW ACTION EQUIPMENT SYSTEM," which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Amusement parks or similar entertainment facilities may use show action equipment—for example an animated character, a robotic arm, or an autonomous vehicle—that has at least some parts that move to enhance the guest experience. Amusement parks or similar entertainment facilities may also have special effects, for example fog or smoke created using liquid nitrogen or dry ice, foam, fluid spray, confetti, bubbles, or flame effects (e.g., flames), to further enhance the guest experience. These special effects may be dynamic and not controlled after being generated, as the special effects may be impacted by environmental factors after they are generated. For example, the bubbles or foam may drift in the breeze; the confetti may be affected by rain; the fog/smoke, fluid spray, or flame effect may be impacted by the wind. These special effects may also be coordinated with the show action equipment but may be in a fixed location and not able to move about with the show action equipment. It is now recognized that this may detract from the illusion that the special effects and the show action equipment is intended to create.

SUMMARY

Certain embodiments commensurate in scope with the originally claimed subject matter are summarized below. These embodiments are not intended to limit the scope of the disclosure. Indeed, the present disclosure may encompass a variety of forms that may be similar to or different from the embodiments set forth below.

In an embodiment, a reactive show action equipment system is disclosed, including show action equipment having an actuator and a special effects system coupled to the show action equipment. The special effects system includes an effects source and an effect emitter configured to expel a substance from the effects source to provide a special effect. The reactive show action equipment system also includes a sensor configured to detect a characteristic of the special effect or a characteristic impactful to the special effect and transmit data indicative of the characteristic. A control system is configured to receive the data indicative of the characteristic and instruct the actuator based on the data indicative of the characteristic.

In an embodiment, a reactive show action equipment system is disclosed. The reactive show action equipment system includes an animated figure, an actuator that is configured to move a portion of the animated figure, a show action controller configured to instruct the actuator, a special effects system including an effects source and a nozzle assembly configured to expel a substance from the effects source to provide a special effect. The reactive show action equipment system also includes a sensor configured to detect a characteristic of the special effect or a characteristic impactful to the special effect and transmit data indicative of the characteristic. A control system is configured to receive the data indicative of the characteristic and instruct the actuator based on the data indicative of the characteristic.

In an embodiment, a method of operating reactive show action equipment is disclosed. The method includes receiving input data from an input source as received input, determining, based on the received input, a type of special effect to produce from a special effect system disposed on show action equipment as a determined type of special effect, controlling the special effect system to produce the determined type of special effect as a produced special effect, receiving data indicative of a characteristic of the produced special effect, determining a reaction for the show action equipment based on the data indicative of a characteristic of the produced special effect as a determined reaction, and producing the determined reaction by controlling at least one actuator of the show action equipment.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
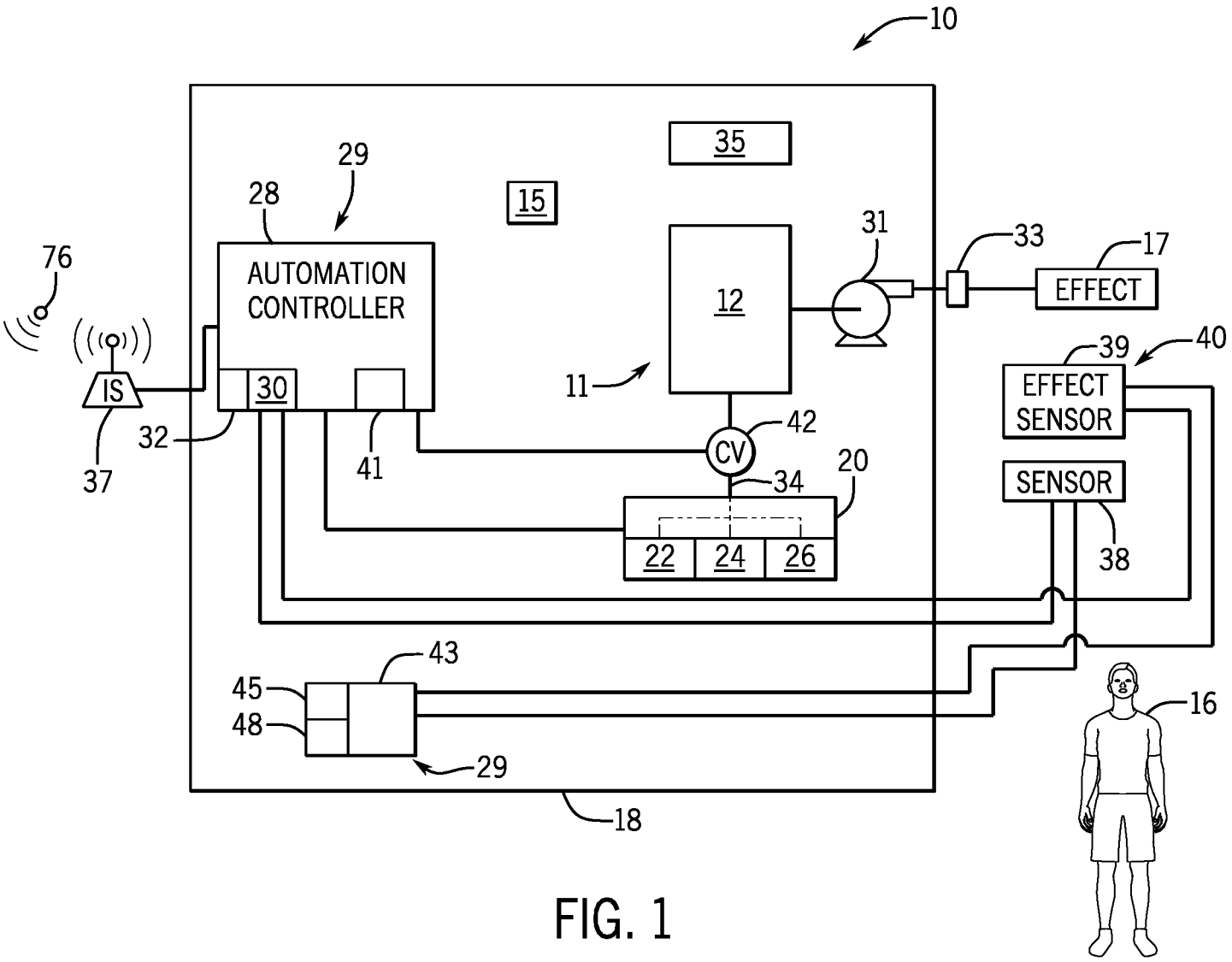
FIG. 1 is a schematic block diagram of an embodiment of a reactive show action equipment system, in accordance with present embodiments.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Further, to the extent that certain terms such as parallel, perpendicular, and so forth are used herein, it should be understood that these terms allow for certain deviations from a strict mathematical definition (as would be understood by one of ordinary skill in the art), for example to allow for deviations associated with manufacturing imperfections and associated tolerances.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates generally to the field of special effects and show action equipment. More specifically, embodiments of the present disclosure relate to systems and methods for experiences using special effects that are onboard show action equipment and are activated and adjusted under certain conditions. Indeed, it is presently recognized that it may be desirable to provide a system that includes special effects at least partially located on or in the show action equipment, such that when the special effects are activated, the show action equipment reacts in response to the special effects, or reacts to cause the characteristics of a subsequent special effect to be impacted, or a combination of both, to enhance the illusion that the show action equipment and the special effects are intended to create.

It is now recognized that amusement park attractions may benefit from having a special effects system that produces one or more special effects (e.g., fog/smoke, foam, fire effect, fluid spray, bubbles, confetti) and that is physically coupled with (i.e., onboard, disposed on) show action equipment (e.g., animated figure, autonomous vehicle, robotic arm) to further enhance the guests' experiences. Indeed, it is now recognized that having a special effects system onboard show action equipment can further enhance the experience of guests experiencing the show action equipment, especially where the show action equipment is capable of reacting to the special effect that it generates. As an example, an animated figure that is a dolphin may have a special effect of fluid spray coming out of its blowhole. The fluid spray may cause a reaction in the animated figure dolphin—for example a movement of the dolphin's tail to flick the fluid spray in a certain direction. Because the special effects system is onboard the animated figure, when the animated figure reacts to the special effect with a movement, the special effects move as well, which enhances the illusion. Accordingly, present embodiments are directed to a reactive show action equipment system where the special effects system is onboard the show action equipment and the show action equipment reacts to the special effects.

In the present disclosure, reference is frequently made to use of present embodiments in an amusement park; however, it should be understood that an amusement park is only one example of many different venues in which present embodiments may be employed. Embodiments may also be employed at concerts, public gatherings, festivals, and other entertainment venues.

FIG. 1 is a schematic block diagram of an embodiment of a reactive show action equipment system 10. In the illustrated embodiment, the reactive show action equipment system 10 includes, among other things, a special effects system 11 and show action equipment 18. The show action equipment 18 may be, for example, an animated figure, and includes a show action controller 43. In other embodiments, the show action equipment 18 may be a mechanical device such as a robotic arm or an autonomous vehicle. The show action equipment 18 is controlled by the show action controller 43 and the special effects system 11 (which may also be controlled by the show action controller 43) may be programmed to emit a special effect 17 (for example, fog/smoke, foam, fluid spray, confetti, bubbles, or flame effect), as described in more detail below.

In the illustrated embodiment, the special effects system 11 includes an effect emitter 12 (e.g., a nozzle assembly) that may be employed to produce the special effect 17, which may be representative of several different individual or combined special effects. The effect emitter 12 is in passive fluid communication with an effects source 20, meaning that fluid is capable of flowing from the effects source 20 to the effect emitter 12, assuming any obstructions such as valves are in an open position. The effects source 20 includes one or more compartments or tanks (e.g., a first tank 22, a second tank 24, and a third tank 26), and each tank may include a different substance required to produce a desired type of the special effect 17. The special effect 17 may include without limitation fog/smoke, foam, fluid spray, confetti, bubbles, or flame effect. For example, the first tank 22 may include a combustible material, such as propane, used in creating a flame effect. The second tank 24 may include fluid, used in creating a fluid spray effect. The third tank 26 may include liquid nitrogen or dry ice, used in creating a fog or smoke effect. In another embodiment, the tanks 22, 24, 26 may be filled with the same substance to produce the same special effect 17. In another embodiment, the special effects system 11 may have only one tank (e.g., only tank 22), two tanks (e.g., only tanks 22 and 24), or three or more tanks. The fluid making up the fluid spray may include room temperature or chilled potable water, steam, glycol, mineral oil, surfactant-based foam or bubbles, scented air, and the like.

The effect emitter 12 is configured to produce (e.g., expel, convey) the substance required from the effects source 20 to generate the special effect 17. For example, if a flame effect is to be generated, the effect emitter 12 produces the propane from the first tank 22. If a flame effect is one of the special effects capable of being produced by the special effects system 11, then the special effects system 11 may also include an igniter 33 to ignite the propane from the effect emitter 12 to produce the flame effect. As other examples, to produce a fluid spray special effect, the effect emitter 12 may produce fluid from the second tank 24; to produce a fog or smoke special effect, the effect emitter 12 may produce liquid nitrogen or dry ice from the third tank 26. In other embodiments, the special effect 17 may include a foam effect, confetti, or bubbles. To produce a foam effect, the effect emitter 12 may produce soap or other material used to produce the foam from the effects source 20 (e.g., from the tank 22); to produce bubbles, the effect emitter 12 may produce soap or other material used to produce the bubbles from the effects source 20 (e.g., from the tank 24); to produce confetti, the effect emitter 12 may produce the confetti suspended in air or other fluid flow from the effects source 20 (e.g., from tank 26).

In certain embodiments, the effect emitter 12 may include a nozzle assembly or a series of nozzle assemblies. In other embodiments, the effect emitter 12 may include other types of emission devices including but not limited to a spout, pipe, hose, tube, or the like.

In the illustrated embodiment, the special effects system 11 includes a control system 29. The control system 29 may include an automation controller 28, which includes a processor 30 and a memory 32. The control system 29 executes computer readable instructions (e.g., a computer program) on the memory 32 that may include logic that determines which type of the special effect 17 to generate. Based on the determination of the type of the special effect 17 to produce, the control system 29 provides data that instructs initiation of active fluid communication (e.g., allowing flow) between at least one of the tanks 22, 24, 26 with a fluid passageway 34 for the effect emitter 12. In the illustrated embodiment, at least one of the tanks 22, 24, 26 may be placed in active fluid communication with the fluid passageway 34 of the effect emitter 12 to enable the effect emitter 12 to produce a substance to produce the special effect 17. For example, the control system 29 may instruct to place the first tank 22 having a propane supply in active fluid communication with the fluid passageway 34 to produce a flame special effect.

In another embodiment, the control system 29 may also provide outputs based on one or more control algorithms that account for one or more input data (e.g., manual inputs, sensor measurement values, data feeds). For example, in the illustrated embodiment, the control system 29 receives input data from a communication system 37 (e.g., wired or wireless communication network, the wired or wireless communication network including but not limited to an intranet or the Internet), a sensor 38 disposed in an environment 40 proximate the special effect 17, or both. The sensor 38 (which may be representative of any number of sensors) may provide input data (e.g., a signal including data) related to a guest 16, for example the guest 16 within a certain threshold distance of the sensor 38 (e.g., a motion detection sensor that detects a guest's presence within 10 feet of the motion detection sensor), the guest 16 using an interactive feature (e.g., an interactive toy or other device), or other input data related to the guest 16. Further, the input data into the automation controller 28 may be analog, digital, or both. The sensor 38 may be a linear optical encoder, a magnetic encoder, machine vision camera optics in visible and infrared spectrums, ultrasonic proximity sensor, motion detection sensor, LIDAR (laser), electromagnetic field strength sensor, and the like.

In addition, the communication system 37 and the sensor 38, or some other device or input to the automation controller 28, may provide the automation controller 28 with input data regarding factors in the environment 40 that may be impactful to the special effect 17. For example, the environmental factors may include the proximity of the guest 16 to the environment 40, an interaction from the guest 16 with an interactive feature, brightness, pollution, sunlight, weather conditions, time of day, humidity, barometric pressure, wind conditions, or the presence of the guest 16. For example, if the presence of the guest 16 is not detected, the control system may block the effect emitter from generating the special effect 17.

The input data from the sensor 38 and/or the communication system 37 may be received by the control system 29, more specifically the processor 30 of the automation controller 28, which may execute computer readable instructions (e.g., a computer program) on the memory 32, which represents a tangible (non-transitory), machine-readable medium. The computer program may include logic that considers the input data from the sensor 38, which may represent one or more different sensors, and/or the communication system 37 and determines which type of special effect 17 to produce based in part on the input data. The control system 29 then sends instructions to place the appropriate tank 22, 24, 26 in active fluid communication with the fluid passageway 34 of the special effects system 11 to provide the substance required to produce the chosen special effect 17.

In an embodiment, the control system 29 may use a lookup table, or lookup tables, to determine what type of special effect 17 the effect emitter 12 should produce based in part on the input data received from the sensor 38 and/or the communication system 37 or different communication network. For example, the lookup tables may include mappings between input data (e.g., proximity of the guest 16, wind speed, temperature, brightness) and corresponding desired special effect 17 (e.g., when the guest 16 is close, special effect 17 is a fluid spray effect; when it is windy, special effect 17 is not a flame effect).

In another embodiment, the control system 29 may use a machine learning technique to determine the type of special effect 17 the effect emitter 12 will produce based on the input data. For example, the control system 29 may use a machine learning technique that is trained with training data that includes input data and the various types of the special effect 17 to be produced by the effect emitter 12. The control system 29 may filter certain inputs (e.g., input data from sensor 38 that is duplicated) to increase processing efficiency and/or the control system 29 may periodically delete inputs (e.g., input data from sensor 38) to prevent a database from being full. It should be understood that the control system 29 may also use a combination of lookup tables and machine learning techniques to determine the type of special effect 17 the effect emitter 12 will produce based on the input data.

Additionally, the control system 29 may cooperate with different features of the special effects system 11 (e.g., a pressure regulator 31, a bank of different or backup nozzles and nozzle arrangements in the effect emitter 12) to control different aspects of the special effect 17. For example, if the control system 29 determines that more pressure is needed, the pressure regulator (e.g., a pump, compressor, retracting bladder, and the like) 31 may be activated or the igniter 33 may be activated prior to the entry of the substance into the effect emitter 12. As another example, if the control system 29 determines that the effect emitter 12 or portions thereof are likely not functioning as intended (e.g., due to a clog or other unintended circumstance), the control system 29 may affect closure of a valve, resulting in the non-functional components of the effect emitter 12 being bypassed and directing the substance required to produce the special effect 17 to a set of backup nozzles.

For special effects that are flame effects, the control system 29 may include a burner controller 41 in addition to the processor 30. The burner controller 41 is configured to instruct initiation of an ignition sequence upon receiving a trigger signal from the processor 30. The burner controller 41 instructs ignition of the igniter 33, confirms ignition of the igniter 33, and then proceeds to instruct release of the fuel from the effect source 20 to the effect emitter 12, and the ignition feature 33 ignites the fuel to generate the special effect 17 as a flame. The control system 29 may then analyze all incoming information (e.g., digital or analog input signals from the sensor 38, the communication system 37, or some other input) and determine whether to signal the burner controller 41 to begin the ignition sequence again. While the illustrated embodiment includes the pressure regulator 31, the pressure regulator 31 may represent any various devices that may be employed by the effect emitter 12 to expel the substance including but not limited to a blower, a fan, a compressor, or a retracting bladder.

Continuing with the illustrated embodiment, the control system 29 is configured to instruct the opening of and/or closing of a control valve 42 for the effect emitter 12, respectively, to enable or block fluid flow of the substance required to generate the special effect 17 through the fluid passageway 34 to the effect emitter 12. The control system 29 may instruct opening of and/or closing of the control valve 42 based on measurements and/or information from the sensor 38 and communication system 37 in the same manner as described above, for example, the control system 29 may instruct closing of the control valve 42 if the presence of the guest 16 is not detected by the sensor 38. In some embodiments, the control system 29 may instruct opening of and/or closing of the control valve 42 to a certain finite extent to regulate pressure of the substance required to generate the special effect 17 from the effect source 20 sent to the fluid passageway 34. Alternatively, or in combination with the above-described controls aspect, the control valve 42 may include a regulator, or a regulator may be included in the effect source 20, to regulate pressure. The automation controller 28 may be instructed via the processor 30 to instruct the regulator or the control valve 42 in the manner described above. In other words, in general, the control system 29 instruct regulation of pressure of the substance required to generate the special effect 17 being supplied to the fluid passageway 34 (and, eventually, to the effect emitter 12) based on environmental factors or other inputs supplied by the sensor 38 and/or the communication system 37 that are impactful to the special effect 17. The pressure may be regulated using the pressure regulator 31 as described above, for example a pump, compressor, a blower, a fan, or a retracting bladder.

In addition to the special effects system 11 as described above, the reactive show action equipment system 10 may include the show action equipment 18. The show action equipment 18 includes the show action controller 43, which may include a show action processor 45 and a memory 48. It should be understood that the control system 29 may also include the show action controller 43. It should also be understood that the show action controller 43 may be the same controller as the automation controller 28.

The control system 29 receives data indicative of a characteristic of the special effect 17 from, for example, the sensor 38 and/or an effects sensor 39. For example, the sensor 38 and/or the effects sensor 39 may provide data regarding a characteristic of the special effect 17, such as the type of special effect 17 that is produced, (e.g., a flame effect, a fluid spray effect, a fog/smoke effect, a bubble effect a confetti effect, and/or a foam effect), the location of the special effect 17, and the pressure of the special effect 17. The control system 29 may execute computer readable instructions (e.g., a computer program) on the memory 48, which represents a tangible (non-transitory), machine-readable medium. The computer program may include logic that considers the data indicative of the characteristic of the special effect 17 from the sensor 38, which may represent one or more different sensors, and/or the effects sensor 39, which may also represent one or more different sensors, and determines a reaction for the reactive show action equipment system 10, based on the data indicative of the characteristic of the special effect 17 received from the sensor 38 and/or the effects sensor 39. The reaction for the reactive show action equipment system 10 may be at least (1) moving movable features of the show action equipment 18, (2) an audio reaction, (3) a lighting reaction, or (4) adjusting the direction, volume, or other aspects of a subsequent special effect 17 generated by the special effects system 11. Each is described below.

In an embodiment, the reaction for the show action equipment 18 is for the show action equipment 18 to move a moveable feature of the show action equipment 18. For example, if the special effect 17 is a fluid spray effect, the direction of the fluid spray effect and distance the fluid spray effect travels may each vary depending on environmental factors such as wind, precipitation, humidity, and the like. Thus, the effect sensor 39 may detect the presence of the fluid spray at a particular location in the environment 40 after the fluid spray effect has been generated. The effect sensor 39 may then communicate with the control system 29 which may determine that the reaction for the show action equipment 18 is to make the show action equipment 18 remove the fluid spray or fluid that has been sprayed (e.g., move in a way that appears to be wiping up the fluid spray or appears to be wiping away the fluid that has been sprayed). The control system 29 then instructs a subset of the plurality of actuators 15 in the show action equipment 18 to accomplish that movement in the particular location in the environment 40. The control system 29 may use a lookup table configured to designate the subset of the plurality of actuators 15 based on the data indicative of the characteristic of the special effect 17.

For example, if the special effect 17 is a fog/smoke effect, the effect sensor 39 may detect the presence of the fog/smoke in the environment 40 after the fog/smoke effect has been generated by the special effects system 11. The direction of the fog/smoke and distance it travels may each vary depending on environmental factors such as wind, precipitation, humidity, and the like. The effect sensor 39 may then detect the location of the fog/smoke effect in the environment 40 and communicate with the control system 29, which may determine that the reaction for the show action equipment 18 is to remove the fog/smoke (e.g., "cough" or "wave away" the fog/smoke) and instructs the subset of the plurality of actuators 15 in the show action equipment 18 to remove the fog/smoke.

For example, if the special effect 17 is a flame effect, the effect sensor 39 may detect the presence of the flame in the environment 40 after the flame effect has been generated by the special effects system 11. The control system 29 may determine that the reaction for the show action equipment 18 is to extinguish the flame (e.g., "blow out" the flame) and instructs the subset of the plurality of actuators 15 in the show action equipment 18 to extinguish the flame.

For example, if the special effect 17 is bubbles or foam, the effect sensor 39 may detect the presence of bubbles or foam in the environment 40 after the bubbles or foam have been generated by the special effects system 11. The effect sensor 39 may then communicate with the control system 29, which may determine that the reaction for the show action equipment 18 is to remove or destroy the bubbles or foam (e.g., pop the bubbles or foam) and instructs the subset of the plurality of actuators 15 in the show action equipment 18 to remove or destroy the bubbles or foam.

For example, if the special effect 17 is confetti, the effect sensor 39 may detect the presence of confetti in the environment 40 after the confetti has been generated by the special effects system 11. The effect sensor 39 may then communicate with the control system 29, which may determine that the reaction for the show action equipment 18 is to at least gather or remove the confetti (e.g., "sweep up" the confetti) and instructs the subset of the plurality of actuators 15 in the show action equipment 18 to at least gather or remove the confetti.

In a subset of a plurality of examples, the control system 29 instructs the show action equipment 18 to react to the special effect 17, after that special effect 17 has been generated by the special effects system 11 and has been detected by the effect sensor 39. The effect sensor 39 detects the special effect 17 as well as characteristics of the special effect 17, such as the location of the special effect 17, which may be influenced by environmental factors as described above. The effect sensor 39 then provides the data indicative of the special effect 17 to the control system 29, which determines a reaction of the show action equipment 18 based on the data indicative of the special effect 17. It should be understood that the control system 29 may include the show action controller 43 and the automation controller 28. It should also be understood that the show action controller 43 may be the same controller as the automation controller 28. In another embodiment, the automation controller 28 may be a separate controller than the show action controller 43.

In addition to reactions of the show action equipment 18 that are movements of the show action equipment 18, the show action equipment 18 may react in a different way, such as, for example, by producing an audio effect or a lighting effect. In an embodiment, audio equipment 35 associated with the show action equipment 18 may be instructed by the control system 29 to play a certain phrase or make a certain noise in the direction of the special effect 17 as determined by the data indicative of the special effect 17 provided to the control system 29 by the effect sensor 39. The audio equipment 35 may be, for example, a speaker that is onboard the show action equipment 18, or a speaker that is in the environment 40. The certain phrase or noise may be dependent on the data indicative of the special effect 17, for example the type of special effect 17, as detected by, for example, the effects sensor 39. In another embodiment, the reaction of the show action equipment 18 to the special effect 17 detected by the effect sensor 39 may be a combination of movements and audio. In yet another embodiment, a lighting effect (e.g., a beam of light) may be directed by the control system 29 based on a location of the special effect 17. The lighting effect may be provided in conjunction with movement and/or audio.

The reaction of the reactive show action equipment system 10 also includes adjusting at least the direction, volume, or other aspects of the subsequent special effect 17 generated by the special effects system 11, as described in more detail with regard to FIGS. 2 and 3 below.

As described above regarding the determination of the type of special effect 17 the effect emitter 12 produces, in an embodiment, the control system 29 may use a lookup table, or lookup tables, to determine the reaction of the show action equipment 18 based in part on the data indicative of the special effect 17. For example, the lookup tables may include mappings between data indicative of the special effect 17 (e.g., type of special effect 17, location of special effect 17) and corresponding desired reaction of the show action equipment 18 (e.g., when the special effect 17 is a fluid spray effect, the reaction will be actuating the subset of the plurality of actuators 15 on or in the show action equipment 18 to remove the fluid spray or the fluid that has been sprayed).

In another embodiment, the control system 29 may use a machine learning technique to determine the reaction of the show action equipment 18 based on the data indicative of the special effect 17. For example, the control system 29 may use a machine learning technique that is trained with training data that includes data indicative of the special effect 17 and the various types of reactions available to the reactive show action equipment system 10. The control system 29 may filter certain inputs (e.g., duplicated sensor data) to increase processing efficiency, and/or the control system 29 may periodically delete inputs (e.g., sensor data) to prevent a database from being full. It should be understood that the control system 29 may also use a combination of lookup tables and machine learning techniques to determine the reaction of the reactive show action equipment system 10 based on the data indicative of the special effect 17.

In one embodiment, several special effects 17 may occur in a sequence, as informed by the effect sensor 39 and the sensor 38. For example, if the special effect 17 is a flame effect, the effect sensor 39 may detect the flame effect and the show action processor 45 may determine that the reaction for the show action equipment 18 is to extinguish the flame effect. The show action processor 45 may then instruct a subset of the plurality of actuators 15 in the show action equipment 18 to accomplish that movement. The sensor 38 may detect the movement associated with extinguishing the flame effect, which may then trigger the control system 29 to instruct the special effects system 11 to stop generating the flame effect by closing the active fluid communication with tank 22 associated with the flame effect and instruct the tank 24 to be in active fluid communication with the effect emitter 12 to generate a fog/smoke effect. When the special effects system 11 generates the fog/smoke effect, the effect sensor 39 may detect the fog/smoke and the control system 29 may determine that the reaction for the show action equipment 18 is to remove the fog/smoke. The removal of the fog/smoke may be detected by the sensor 38. The detection by the sensor 38 may trigger the automation controller 28 of the special effects system 11 to instruct stopping of generating the fog/smoke effect by closing the fluid communication with tank 24 associated with the fog/smoke effect and instruct opening of the fluid communication with tank 26 to generate a fluid spray effect. When the special effects system 11 generates the fluid spray effect, the effect sensor 39 may detect the fluid spray effect and trigger the show action processor 45 to instruct a subset of the plurality of actuators 15 in the show action equipment 18 to make the show action equipment 18 remove the fluid spray or fluid that has been sprayed. Because the special effects 17 and reactions are informed by the effect sensor 39 and the sensor 38, the sequences of special effects 17 and reactions need not be pre-programmed but instead can happen in automatically in reaction to inputs to the effect sensor 39 and the sensor 38. This allows for a multitude of potential combinations and sequences of special effects 17 and reactions, which may include other examples of other special effects 17 (e.g., foam, bubbles, confetti, and the like) occurring in a different sequence.

It should be understood that while the illustrated embodiment includes the sensor 38 and the effect sensor 39, these may be the same sensor 38 or may be different sensors 38.

The show action processor 45 and the processor 30 of the automation controller 28 may include one or more processing devices, and the memory 32 and memory 48 may include one or more tangible, non-transitory, machine-readable media. By way of example, such machine-readable media can include RAM, ROM, EPROM, EEPROM, magnetic storage devices, or any other medium which can be used to carry or store desired program code in the form of machine-executable instructions or data structures, and which can be accessed by the processor 30 or by other processor-based devices. As explained above, the show action processor 45 and the processor 30 of the automation controller 28 may be the same processor 30.

In some embodiments, the show action equipment 18 and/or the control system 29 may form a communication connection with the sensor 38 and/or the effect sensor 39 using a wireless communications system 76, for example, wireless communication paths via infra-red (IR) wireless communication, radio frequency transmission, Bluetooth, Wi-Fi, ultra-wideband (UWB), etc. That is, the sensor 38 and/or the effect sensor 39 may include devices that enable the communication between the show action equipment 18 and the sensor 38 and/or the effect sensor 39. For example, the sensor 38 and/or the effect sensor 39 may include communication circuitry such as a transmitter and/or a receiver. The communication connection may include wireless communication protocols, for example UWB, IR, or radio frequency transmission, that enable communication between electronic devices over a distance, such as between 4 meters (m) and 20 m. In addition, in some embodiments, the communication connection may be formed using a wired communications system, such as using fiber optic cables, Ethernet cables, telephone network cables, coaxial cables, twisted pair cables, or waveguide cables.

Figure 2:
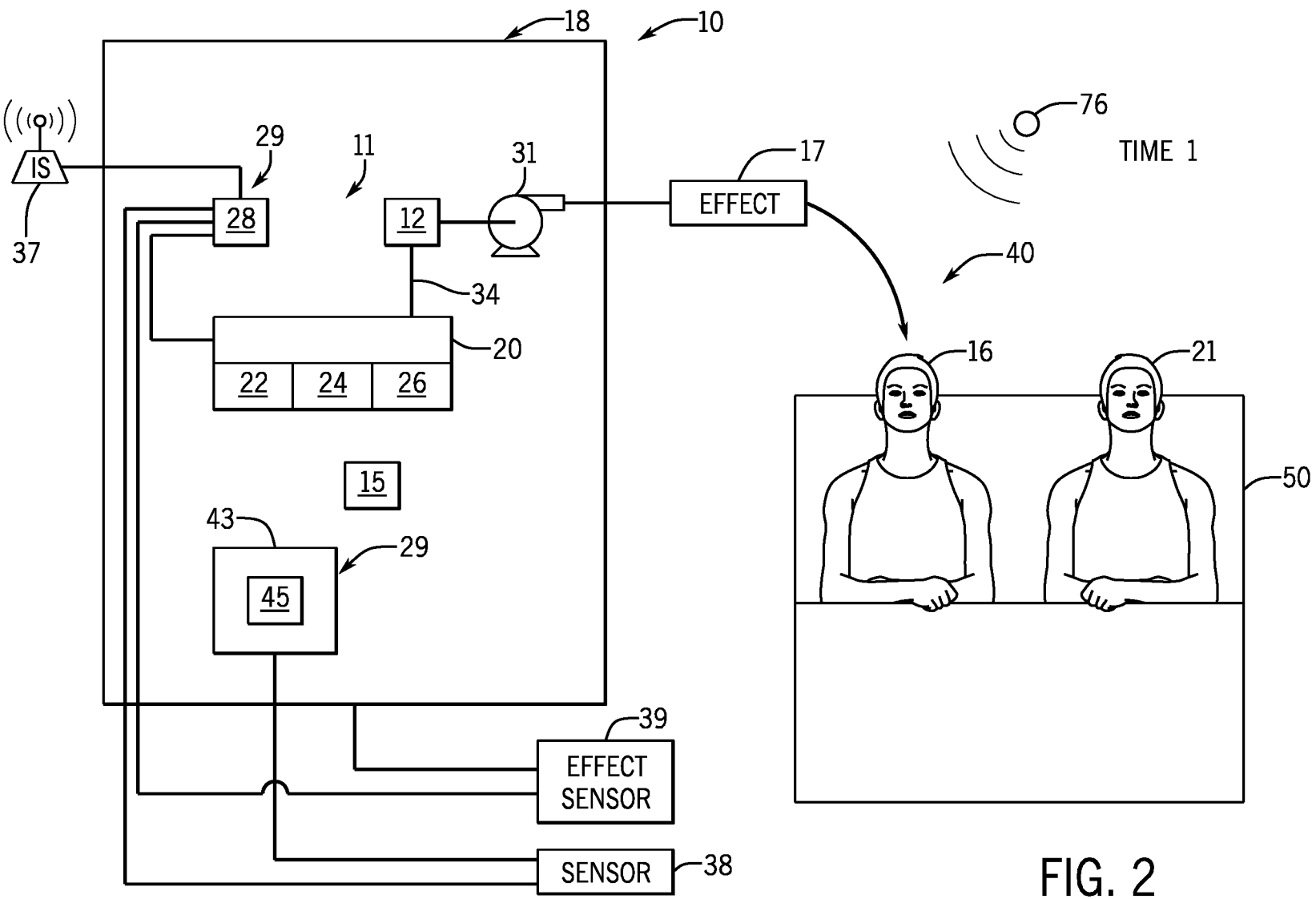
FIG. 2 is a schematic illustration of an embodiment of a reactive show action equipment system interacting with guests, in accordance with present embodiments.
Figure 3:
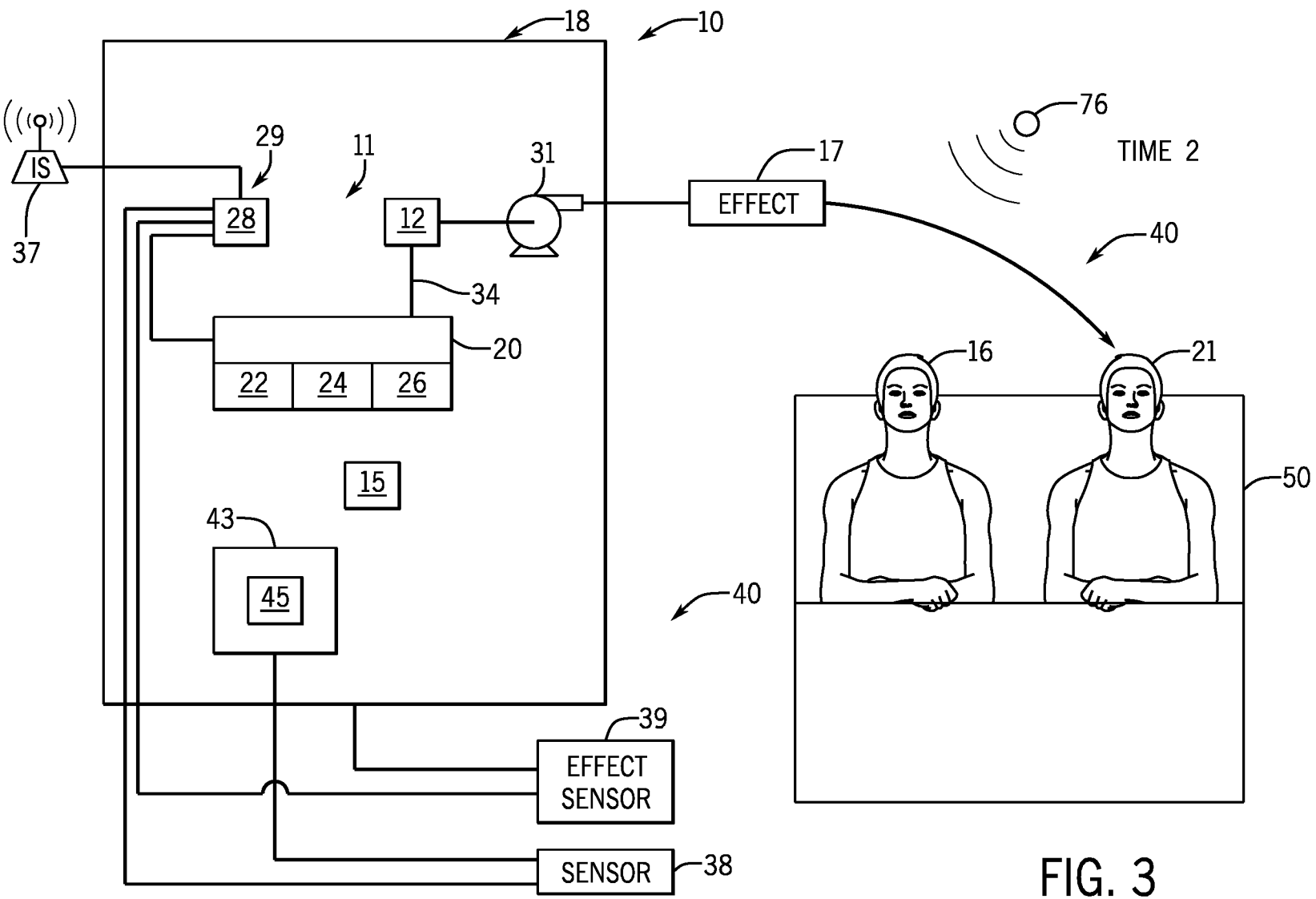
FIG. 3 is a schematic illustration of an embodiment of a reactive show action equipment system interacting with guests, in accordance with present embodiments.

FIGS. 2 and 3 are each a schematic illustration of another embodiment of the reactive show action equipment system 10 where the effect sensor 39 detects a volume and direction of the special effect 17 that includes a fluid spray effect and provides data indicative of the special effect 17 to the control system 29. The control system 29 may then provide instructions to the effect emitter 12 to alter the special effects system 11 by adjusting the at least direction, volume, or other aspects of the next special effect 17 generated by the special effects system 11.

In FIG. 2, in response to input received from the sensor 38, the special effects system 11 produces the special effect 17 that includes a fluid spray effect that has a specific volume and direction and splashes the guest 16 in a ride vehicle 50 at time 1. After the fluid spray effect is generated by the special effects system 11, the effect sensor 39 detects data indicative of the special effect 17, for example the direction of the fluid spray effect and the distance the fluid spray effect travels. The direction of the fluid spray effect and distance the fluid spray effect travels may each vary depending on environmental factors such as wind, precipitation, humidity, barometric pressure, and the like. After the effect sensor 39 detects the direction and distance of the fluid spray effect, the effect sensor 39 may provide output to the control system 29, which may then alter the special effects system 11, for example by instructing the effect emitter 12 to spray in a different direction, or by instructing the pressure regulator 31 (e.g., pump, compressor, fan, blower, or retractable bladder) in the special effects system 11 to apply more pressure to result in a subsequent fluid spray effect landing in a different location.

As shown in FIG. 3, at time 2, which is a period after time 1, the special effects system 11 is altered by adjusting the effect emitter 12 or other part of the special effects system 11 (e.g., pressure regulator 31) so that a subsequent fluid spray effect does not hit the guest 16 sitting in the same position as the guest 16 but instead hits a guest 21 sitting in another position in the ride vehicle 50. In this way, the sequence and impacts of the special effects 17 are not predictable to other guests 16. In addition to adjusting the direction of the special effect 17, the automation controller 28 may alter the special effects system 11 by instructing the effect source 20 to change the volume of the subsequent special effect 17 or may otherwise alter aspects of subsequent special effects 17 generated by the special effects system 11.

The reaction for the reactive show action equipment system 10 may thus be at least a movement of the show action equipment 18, an audio effect, a lighting effect, or an alteration in the special effects system 11 to adjust at least the direction, volume, or other aspects of the subsequent special effect 17 generated by the special effects system 11. The reaction for the reactive show action equipment system 10 may be a combination of one or more of these reactions.

One or more components of the special effects system 11 may be onboard the show action equipment 18 such that the onboard components are physically coupled to the show action equipment 18. For example, the effect emitter 12, the effect source 20 including the tanks 22, 24, and 26, and the automation controller 28 may be physically coupled to the show action equipment 18 such that when the show action equipment 18 moves (e.g., changes location or orientation), the onboard components of the special effects system 11 likewise adjust (e.g., change location or orientation). In another embodiment, portions of the communication system 37 may also be onboard the show action equipment 18, although it should be understood that this embodiment does not contemplate the entire communication system 37, including the Internet, being onboard the show action equipment 18. In another embodiment, only the effect emitter 12 may be onboard the show action equipment 18. In another embodiment, the effect emitter 12 and the effect source 20 including the tanks 22, 24, and 26 are onboard the show action equipment 18, but the automation controller 28 and the communication system 37 are offboard (i.e., not physically attached to) the show action equipment 18. In another embodiment, the sensor 38 and/or the effect sensor 39 may be onboard the show action equipment 18. Having portions of the special effects system 11 onboard the show action equipment 18 enhances an illusion related to the special effect 17 coming from the show action equipment (e.g., animated figure) 18. Additionally, and alternatively, one or more components of the special effects system 11 may be offboard (i.e., not attached to) the show action equipment 18. In these embodiments, the one or more components of the special effects system 11 that are offboard the show action equipment 18 may also travel with the show action equipment 18, or may be offboard the show action equipment 18 and be at least position independent or orientation independent of the show action equipment, meaning the position or orientation of the one or more components of the special effects system 11 that are offboard the show action equipment 18 is not related to the position or orientation of the show action equipment 18.

Figure 4:
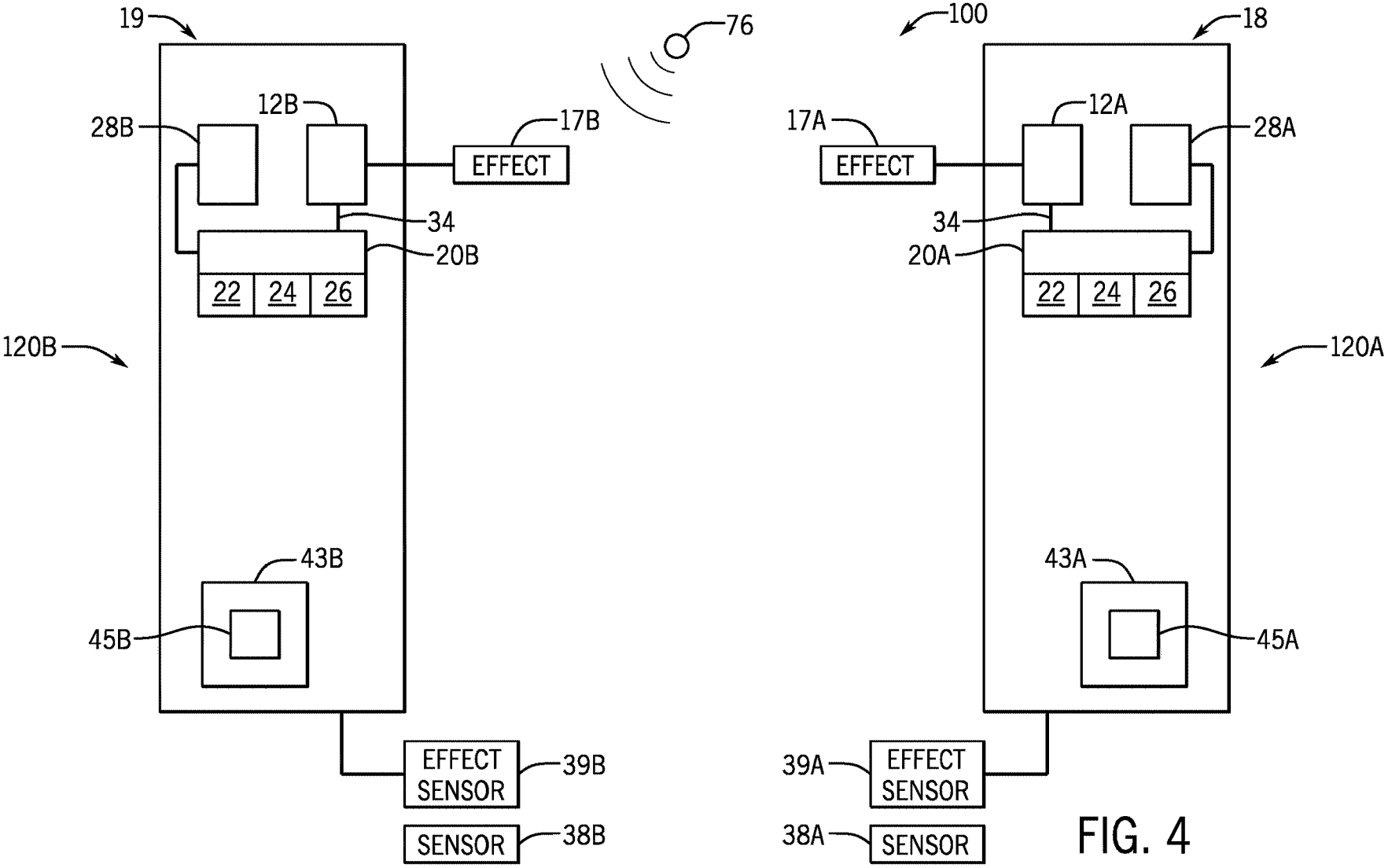
FIG. 4 is a schematic illustration of two reactive show action equipment systems interacting with each other, in accordance with present embodiments.

FIG. 4 is a schematic illustration of another embodiment of a reactive show action equipment system 100. The reactive show action equipment system 100 may include one show action equipment 18 having a special effects system 120A and an additional show action equipment 19 having an additional special effects system 120B. In this embodiment, the special effects system 120A on or in a first show action equipment 18 produces a special effect 17A in response to input data, as described above. The effect sensor 39B of the second show action equipment 19 detects the special effect 17A produced by the first show action equipment 18 and the show action processor 45B of the second show action equipment 19 determines a reaction for the second show action equipment 19, based on the type of special effect 17A generated.

For example, the special effects system 120A of the first show action equipment 18 may generate a fluid spray special effect as the special effect 17A. The special effect 17A from the first show action equipment 18 may be sensed by the effect sensor 39B of the second show action equipment 19. The show action processor 45B of the second show action equipment 19 may determine the reaction for the second show action equipment 19 to be moving (e.g., as if wiping the eyes of the second show action equipment 19) and instruct the subset of the plurality of actuators 15 to affect such movements. The show action processor 45B of the second show action equipment 19 may also provide an input to the automation controller 28B of the second special effects system 120B of the second show action equipment 19. This input may trigger the automation controller 28B to determine a reaction to the special effect 17A from the first show action equipment 18, for example, a return fluid spray effect, 17B. The automation controller 28B may then instruct opening of the fluid passageway 34B (not pictured in FIG. 4) for the fluid to come from the appropriate tank 22B in the effect source 20B and to the effect emitter 12B of the second show action equipment 19 to generate a reactive fluid spray effect as the special effect 17 from the second show action equipment 19. In this way, the first show action equipment 18 and the second show action equipment 19 may be viewed as having a fluid spray fight, as each show action equipment is reacting to special effects generated by the other show action equipment. While a fluid spray fight is used in this example, it should be understood that the special effects 17A and 17B may be of any type (e.g., flame effects, fog/smoke effects, and the like) and the reactive special effect 17B from the second show action equipment 19 may be different than the special effect 17A from the first show action equipment 18. It should be understood that in this embodiment of the reactive show action equipment system 100 and each show action equipment 18, 19 may share certain components of the reactive show action equipment system 100. For example, each show action equipment 18, 19 may have its own designated automation controllers 28A and 28B and the show action controller 43A and 43B or they may share the automation controller 28 and the show action controller 43. In addition, as described above, it should be understood that the show action controller 43 may be the same controller as the automation controller 28. As another example, each show action equipment 18, 19 may communicate with its own sensor 38A and 38B, respectively, and/or effect sensor 39A and 39B, respectively, or each show action equipment 18, 19 may share the sensor 38 and/or the effect sensor 39. As also described above, the sensor 38 and/or the effect sensor 39 may be the same sensor or a series of sensors.

Figure 5:
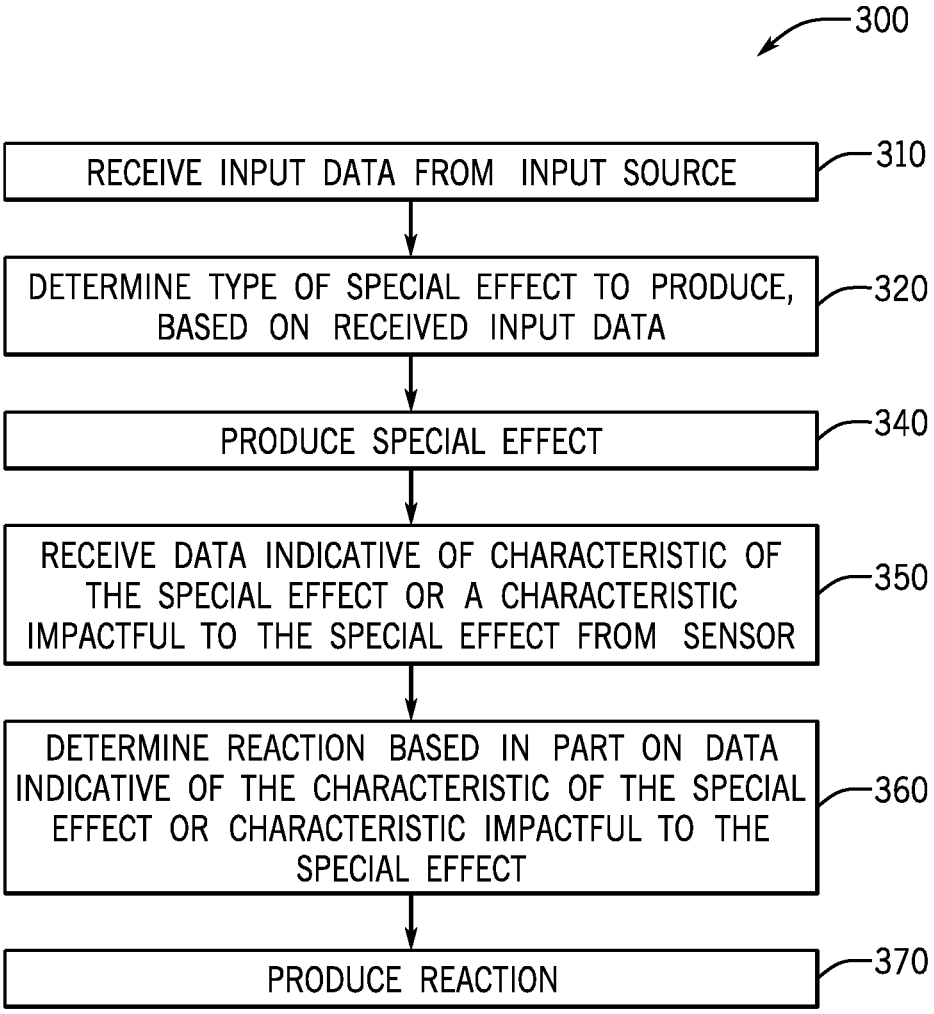
FIG. 5 is a flow diagram illustrating a method of operating a reactive show action equipment system, in accordance with present embodiments.

FIG. 5 is a flow diagram illustrating one embodiment of a method 300 of operating the reactive show action equipment system 10, in accordance with present techniques. It is to be understood that the steps discussed herein are merely exemplary, and certain steps may be omitted or added, and the steps may be performed in a different order. In one embodiment, the steps of the method 300 may be executed by the reactive show action equipment system 10.

The method 300 includes a step of receiving input data from an input source (block 310). The input source may be the sensor 38 or effect sensor 39 or communication system 37. The input data may be received using wired or wireless communications system 76 (e.g., circuitry) and may be received by the control system 29. The method 300 also includes a step of determining the type of special effect 17 to produce, based on the input data received from the input source (block 320). For example, the input source may be a motion detector that indicates that the guest 16 is in close proximity to the show action equipment 18 (e.g., an animated figure) when the guest 16 is in close proximity to the show action equipment 18. Based on that input, the show action processor 45 determines that a fluid spray special effect 17 in the direction of the guest 16 should be produced. As described above, a lookup table and/or machine learning may be used to determine the type of special effect 17 to be produced. The method 300 also includes the step of producing the special effect 17 (block 340). This may include opening the control valve 42 to enable fluid flow from the appropriate tank (e.g., the first tank 22) in the effect source 20, depending on the type of special effect 17 produced (block 330). For example, to produce a fluid spray special effect, the control valve 42 is opened to place the appropriate tank (e.g., the first tank 22) in the effect source 20 that contains fluid in active fluid communication with the effect emitter 12 (e.g., nozzle assembly). This also may include, for example, producing the fluid spray special effect from the effect emitter 12 in accordance with the input data received regarding the direction in which to produce the fluid spray special effect. The method 300 also includes the step of receiving data indicative of the characteristic of the special effect 17 or a characteristic impactful to the special effect from the effect sensor 39 (block 350). For example, the effect sensor 39 provides data regarding at least the volume, direction, and pressure of the produced fluid spray special effect, which may vary depending on environmental factors as described above. The method 300 also includes the step of determining a reaction of the reactive show action equipment system 10 based in part on the data indicative of a characteristic of the special effect or a characteristic impactful to the special effect, e.g., data received from the effect sensor 39 regarding at least the volume, direction, and pressure of the produced fluid spray special effect (block 360). The reaction of the system may be, for example, any of the reactions previously described including an audio effect from the show action equipment 18, a lighting effect, an adjustment of the special effects system 11, a movement of the show action equipment 18, or another special effect 17 produced. For example, the reaction may be to adjust the direction of the effect emitter 12 or the pressure regulating device (e.g., pump) associated with producing the special effect. As another example, the reaction may be a reaction from the show action equipment 18, for example moving away from the guest 16 who was impacted by the fluid spray special effect. The method 300 also includes the step of producing the determined reaction (block 370). Thus, the reaction that was determined in the previous step is produced, for example altering a component of the special effects system 11 such as the effect emitter 12 or the pump pressure or moving the show action equipment 18 via powering the subset of the plurality of actuators 15, or producing an audio effect, or producing another special effect 17 in a sequence. By having the special effects system 11 onboard the show action equipment 18, it enhances the illusion for the guest when the show action equipment 18 moves, and the special effects system 11 moves as well.

While only certain features of the invention have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A reactive show action equipment system comprising:
a plurality of actuators;
show action equipment;
a special effects system coupled to the show action equipment, the special effects system comprising:
an effects source; and
an effect emitter configured to expel a substance from the effects source to provide a first special effect;
a sensor configured to detect a characteristic of the first special effect and transmit sensor data indicative of the characteristic; and
a control system configured to:
receive the sensor data indicative of the characteristic of the first special effect;
instruct at least movement or orientation of the show action equipment by instructing a subset of the plurality of actuators based on the characteristic of the first special effect; and
instruct the special effects system to provide a second special effect different from the first special effect by adjusting the effects source, the effects emitter, or both based on the characteristic of the first special effect.

2. The reactive show action equipment system of claim 1, wherein one or more components of the special effects system is onboard the show action equipment and travels with the show action equipment, is offboard the show action equipment and travels with the show action equipment or is offboard the show action equipment and is at least position independent or orientation independent of the show action equipment.

3. The reactive show action equipment system of claim 1, wherein the control system is configured to instruct a reaction based on the characteristic of the first special effect, wherein the reaction is at least an audio effect, a lighting effect, movement of the show action equipment, or an alteration to the special effects system.

4. The reactive show action equipment system of claim 3, wherein the control system is configured to use one or more machine learning algorithms to determine the reaction based on the characteristic of the first special effect.

5. The reactive show action equipment system of claim 1, wherein the control system comprises:
a show action controller configured to instruct the subset of the plurality of actuators based on the characteristic of the first special effect; and
an automation controller separate from the show action controller and configured to instruct the special effects system to provide the second special effect different from the first special effect by adjusting the effects source, the effects emitter, or both based on the characteristic of the first special effect.

6. The reactive show action equipment system of claim 1, wherein the effects source comprises at least a first tank and a second tank, and the first tank contains at least a first substance to produce the first special effect as a first type of special effect and the second tank contains at least a second substance to produce the second special effect as a second type of special effect.

7. The reactive show action equipment system of claim 1, wherein the first special effect comprises at least bubbles, fluid spray, flames, foam, smoke, fog, or confetti.

8. The reactive show action equipment system of claim 1, wherein the effect emitter comprises a nozzle assembly and the special effects system comprises a pressure regulator configured to convey the substance from the effects source to the nozzle assembly.

9. The reactive show action equipment system of claim 1, wherein the control system comprises a lookup table configured to designate the subset of the plurality of actuators based on the characteristic of the first special effect.

10. The reactive show action equipment system of claim 1, comprising an additional sensor configured to detect additional sensor data indicative of at least brightness, pollution, sunlight, weather conditions, time of day, humidity, barometric pressure, wind conditions, presence of one or more guests, or proximity of one or more guests associated with the first special effect.

11. The reactive show action equipment of claim 10, wherein:
the additional sensor is configured to detect whether one or more guests are present, and
the control system is configured to instruct blocking of the effect emitter from expelling the substance when a guest presence is not detected by the additional sensor.

12. The reactive show action equipment system of claim 1, comprising additional show action equipment having an additional special effects system, wherein the additional show action equipment is configured to react to the first special effect.

13. The reactive show action equipment system of claim 1, wherein the characteristic comprises a type of special effect associated with the first special effect, a location of the special effect associated with the first special effect, a volume associated with the substance, a direction associated with the substance, a pressure associated with the substance, or a combination thereof.

14. A reactive show action equipment system, comprising:
an animated figure;
one or more actuators that are configured to move a portion of the animated figure;
a show action controller configured to instruct the one or more actuators;
a special effects system comprising:
an effects source; and
a nozzle assembly configured to expel a substance from the effects source to provide a special effect;
an effect sensor configured to detect a characteristic of the special effect and transmit sensor data indicative of the characteristic; and
a control system configured to:
receive the sensor data indicative of the characteristic of the special effect; and
control the one or more actuators to move the portion of the animated figure based on the characteristic of the special effect.

15. The reactive show action equipment system of claim 14, wherein the control system is configured to instruct a reaction in response to the sensor data indicative of the characteristic of the special effect, wherein the reaction is at least an audio effect, a lighting effect, movement of a portion of the animated figure, or an alteration to the special effects system.

16. The reactive show action equipment system of claim 14, wherein one or more components of the special effects system is onboard the animated figure and travels with the animated figure, is offboard the animated figure and travels with the animated figure or is offboard the animated figure and is at least position independent or orientation independent of the animated figure.

17. The reactive show action equipment system of claim 14, wherein the special effects system comprises a pressure regulator configured to convey the substance from the effects source to the nozzle assembly.

18. A method of operating a reactive show action equipment system, the method comprising:

receiving input data from an input source as received input;

determining, based on the received input, a type of special effect to produce from a special effect system having components disposed onboard or offboard show action equipment as a determined type of special effect;

controlling the special effect system to produce the determined type of special effect as a produced special effect, wherein the special effect system comprises an effects source and an effect emitter configured to expel a substance from the effects source to provide the produced special effect;

receiving sensor data indicative of a characteristic of the produced special effect from a sensor configured to detect the characteristic of the produced special effect; and controlling one or more actuators to move a portion of the show action equipment based on the characteristic of the produced special effect.

19. The method of claim 18, wherein the input source is an additional sensor or a communication system and the input data is received using a wired communications system or a wireless communications system.

20. The method of claim 18, wherein the characteristic comprises a location associated with the produced special effect, a volume associated with the substance, a direction associated with the substance, a pressure associated with the substance, or a combination thereof.

* * * * *